US005537933A

United States Patent [19]

Ablad

[11] Patent Number: 5,537,933

[45] Date of Patent: Jul. 23, 1996

[54] SEGMENTED SAFETY RAIL WITH A MOVABLE TROLLEY

[76] Inventor: Bjorn Ablad, 1162 Vista View Dr., Salt Lake City, Utah 84108

[21] Appl. No.: 527,029

[22] Filed: Sep. 12, 1995

[51] Int. Cl.[6] ..... B61C 17/04; B61B 13/04; A62B 35/00

[52] U.S. Cl. ..... 105/457; 105/142; 104/250; 104/252; 104/119; 104/125; 238/10 R; 182/3; 182/36

[58] Field of Search ..... 105/457, 461, 105/26.05, 142, 143; 104/89, 93, 111, 118, 119, 120, 121, 125, 126, 137, 250, 252; 238/10 R; 182/3, 8, 13, 36

[56] References Cited

U.S. PATENT DOCUMENTS

| | | | |
|---|---|---|---|
| 44,134 | 9/1864 | Worsley | 105/457 |
| 1,395,559 | 11/1921 | Davis | 105/142 |
| 3,124,082 | 3/1964 | Larsen | 104/250 X |
| 3,217,833 | 11/1965 | Smith | 182/3 |
| 4,037,824 | 7/1977 | Whitmer | 256/53 |
| 4,454,928 | 6/1984 | Marteau et al. | 182/36 |
| 4,606,430 | 8/1986 | Roby et al. | 182/3 |
| 4,767,091 | 8/1988 | Cuny | 248/228 |
| 4,917,215 | 4/1990 | Pratt | 182/3 |
| 5,271,481 | 12/1993 | Rich | 182/3 |
| 5,279,385 | 1/1994 | Riches et al. | 182/3 |
| 5,297,651 | 3/1994 | Vandelinde | 182/3 |
| 5,325,788 | 7/1994 | Strickland et al. | 104/119 |
| 5,343,975 | 9/1994 | Riches et al. | 182/3 |

*Primary Examiner*—Robert J. Oberleitner
*Assistant Examiner*—Kevin D. Rutherford
*Attorney, Agent, or Firm*—Workman, Nydegger & Seeley

[57] ABSTRACT

A safety system for restraining and preventing a person from falling off an elevated structure such as a locomotive. The safety system includes a segmented rail structure comprising a plurality of releasable and/or removable rail sections that are supported by a series of rail posts. The rail sections can be released and/or removed in order to provide access to an adjacent locomotive compartment to be serviced. A pair of spring biased support members are attached to each of the rail posts and automatically extend when corresponding section is removed. A moveable trolley apparatus engages the rail sections with a plurality of wheels, and has an extendable arm that can be connected to a lanyard worn by a maintenance person. When extended, the raised support members prevent the trolley from coming off the end of a rail section adjacent to a rail section that has been removed. The safety system restrains and prevents a person who must perform mechanical repairs on a locomotive from slipping or falling off the top of the locomotive.

36 Claims, 6 Drawing Sheets

SEGMENTED SAFETY RAIL WITH A MOVABLE TROLLEY

BACKGROUND OF THE INVENTION

1. The Field of the Invention

The present invention relates to a safety device for preventing falling. More particularly, the present invention is directed to a segmented safety rail with a moveable trolley engaged thereon that can be used to restrain and prevent maintenance personnel who must perform mechanical repairs on diesel locomotives from slipping or falling off the top of the locomotives.

2. The Relevant Technology

The locomotives used to pull railroad cars are generally divided into a series of serviceable compartments. These different compartments may house electrical or mechanical components of the diesel engine which are separately serviceable. If a particular compartment needs to be serviced, a hatch or roof plate over the compartment can be opened. This provides access into the locomotive or permits the contents of the compartment to be lifted out for servicing. In order to perform such service in a particular compartment, it is necessary for maintenance personnel to get on top of the locomotive to assist in this work. A number of injuries and fatalities have occurred from such personnel falling off the top of a locomotive.

A number of safety devices have been developed to restrain a worker from falling off an elevated structure. These previous safety devices, however, have not addressed the problem of securing a person working on top of a locomotive, which is complicated due to the different designs, models, and manufacturers of locomotives used on railroads. The different models of locomotives in use have smoke stacks and horns in different locations, as well as doors and roof plates that open in different ways and at different locations along the length of the locomotive. In some locomotives, fans and other engine assemblies are pulled out from the top of the locomotives. While all locomotives are approximately 6 feet wide, various models have different lengths.

Accordingly, there is a need for a safety device for preventing falling of maintenance personnel that can be used on the various models and designs of locomotives in operation.

SUMMARY AND OBJECTS OF THE INVENTION

The present invention is directed to a safety system for restraining and preventing a person from falling off an elevated structure. The safety system comprises a segmented rail structure including a plurality of releasable rail sections that are supported by a series of rail posts. The rail posts have attached thereto a pair of spring biased support members that automatically raise when an overlying rail section is removed. A moveable trolley apparatus is placed about the rail structure and includes a trolley frame with a plurality of wheels that engage the rail sections. An extendable arm is attached to the trolley frame and has means for anchoring a safety lanyard to the trolley. This enables maintenance personnel to move about on the elevated structure, with the lanyard attached to the movable trolley to prevent such persons from falling off the elevated structure.

In a preferred embodiment, the segmented rail structure comprises a series of rail sections or segments mounted on the roof of a locomotive running the length of the top of the locomotive. The rail sections are preferably made from steel I-beams attached along the top of the locomotive and have rail joints therebetween corresponding to different serviceable compartments of the locomotive. The rail joints are offset from roof joints between the roof plates over the compartments of the locomotive. The rail joints allow a specific rail section to be released from the adjacent sections so that the specific rail section can be moved so an underlying roof plate can be opened to provide access to a compartment to be serviced.

The rail structure on the locomotive is supported by a series of rail posts located beneath the rail joints. The rail posts have attached thereto on either side of the rail joints a pair of spring biased support members. The support members are spring loaded so that the rail sections compress the spring mechanism therein when placed over the support members. When a rail section is released from adjacent sections to permit compartment in the locomotive to be accessed, the underlying support members automatically extend in length by action of the spring mechanism to block the open ends of the remaining adjacent rail sections. A raised support member provides a stop for the moveable trolley engaged on the rail structure to prevent the trolley from coming off the rail structure. This keeps the trolley safely fixed on the rail structure when a rail section is released.

When a maintenance person attaches a lanyard to the trolley, the person is safely tethered and prevented or restrained from falling off the locomotive while traversing the length of the locomotive. More than one trolley may be used at the same time on the rail structure, which allows more than one person to safely move about on the roof of the locomotive. The extendable arm on the trolley can be raised up to allow easy attachment of a lanyard or can be folded down onto the trolley frame when not in use.

The safety system of the present invention can be originally built on new locomotives or can easily be retrofitted to mount onto a locomotive already in operation.

Accordingly, it is an overall object of the present invention to provide a safety system that restrains and prevents maintenance personnel from slipping or falling off the top of an elevated structure such as a locomotive.

Another object of the present invention is to provide a safety systems comprising a series of releasable rail segments.

Still, another object of the present invention is to provide a safety system in which one or more safety rail segments of a series of safety rail segments may be released or moved without comprising the continued use of the remaining rail segments as a safety system.

It is also an object of the present invention to provide a safety system whose segments are separately releasable and/or movable to permit servicing of underlying equipment.

It is another object of the present invention to provide a safety system which is usable indoors or outside.

A further object of the present invention is to provide a safety system for locomotives that is useable at any location.

Yet another object of the present invention is to provide a safety system that is compatible with all the different models of locomotives in operation.

It is also an object of the present invention to provide a safety system that is easy to use so as to ensure usage thereof.

Another object of the present invention is to provide a safety system that provides protection by restraining a person from falling in all types of work on top of a locomotive.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered limiting of its scope, the invention will be described and explained with additional specificity and detail through the use of the accompanying drawings in which:

FIG. 7 is an end view of the moveable trolley of FIG. 6 engaged on segmented rail structure with one rail segment released according to the present invention.

DETAILED DESCRIPTION OF THE INVENTION

The present invention is directed to a safety system for restraining and preventing a person from falling off an elevated structure, such as the roof of a locomotive. The safety system includes a segmented rail structure mounted on top of the elevated structure, and a moveable trolley engaged with the rail structure. Maintenance personnel can attach a lanyard to the moveable trolley prior to performing various repairs, thereby restraining and preventing such persons from slipping or falling off the top of the elevated structure.

Figure 1:
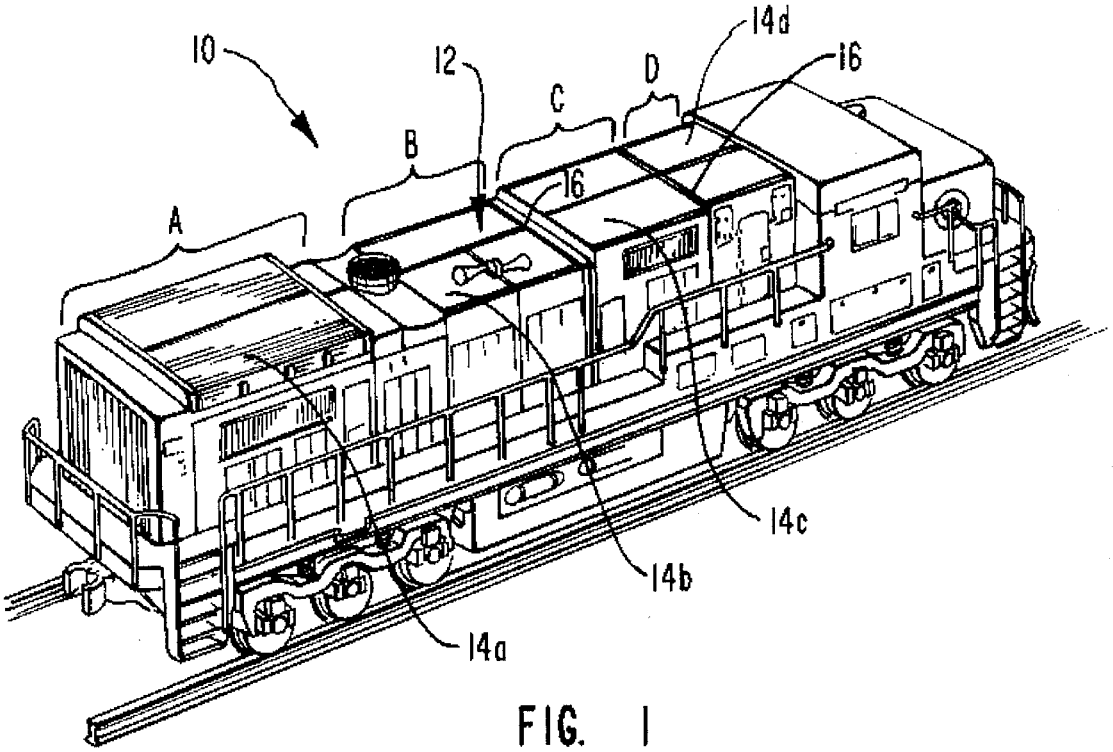
FIG. 1 (PRIOR ART)
FIG. 1 is a perspective view of a conventional locomotive.
Figure 2:
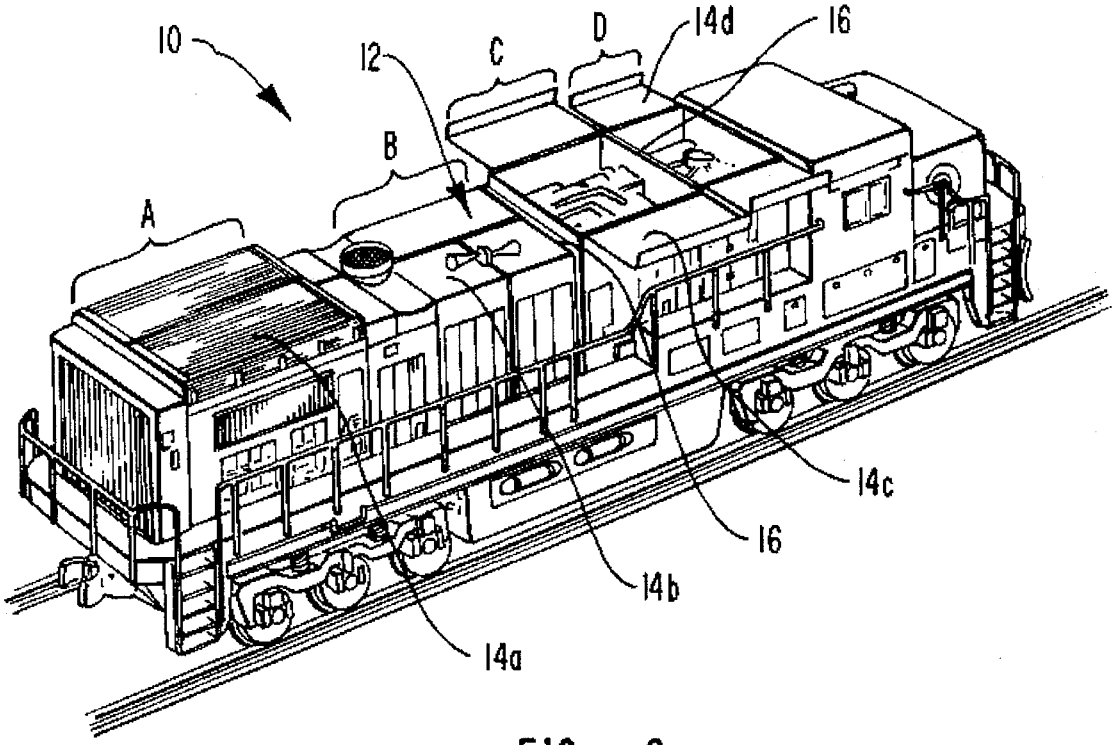
FIG. 2 (PRIOR ART)
FIG. 2 is a perspective view of the conventional locomotive shown in FIG. 1, having the roof plates over two separate compartments opened.

Referring to the drawings, a specific embodiment of the invention will be described as follows. As shown in FIG. 1, a conventional locomotive 10 has a roof 12 and compartments A, B, C and D that may accessed through roof 12. These different compartments may house electrical or mechanical components of the diesel engine in locomotive 10 that are separately serviceable through hinged roof plates 14*a*–14*d* separated by a series of roof joints 16 on roof 12. For example, as shown in FIG. 2, if compartment C or D needed to be serviced, roof plate 14*c* over compartment C or roof plate 14*d* over compartment D can be opened, permitting access into locomotive 10 or permitting the contents of compartment C or D to be lifted out for servicing. In order to perform such service on compartment C or D, it is necessary for maintenance personnel to climb up on top of roof 12 of locomotive 10 to assist in this work.

Figure 3:
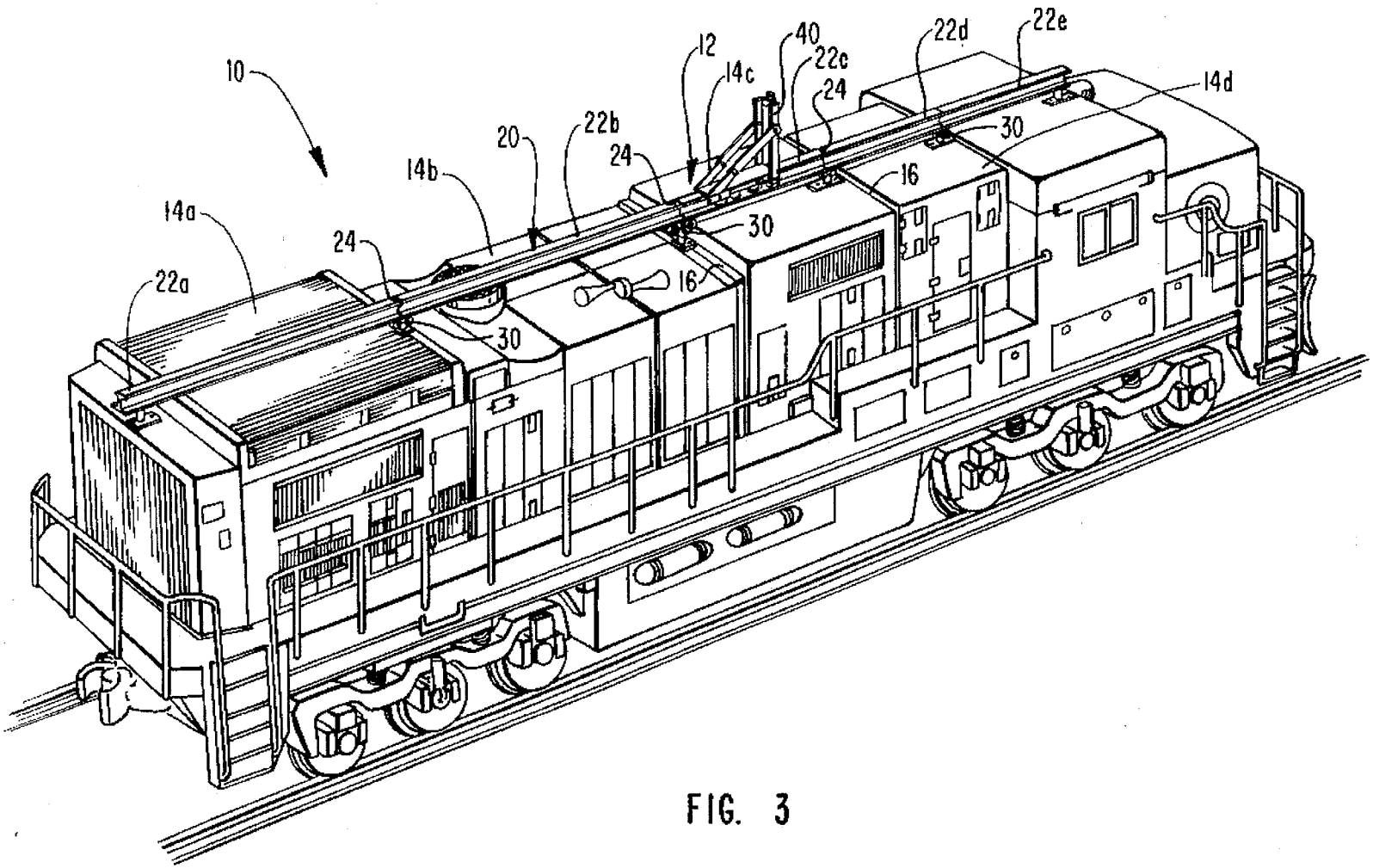
FIG. 3 is a perspective view of a locomotive having a segmented rail structure attached to the roof thereof with a moveable trolley engaged thereon according to the present invention.

FIG. 3 illustrates a segmented rail structure 20 mounted on roof 12 of locomotive 10 according to the present invention, with rail structure 20 running the entire length of locomotive 10. The rail structure 20 is preferably mounted about twelve (12) inches above roof 12 to provide clearance for smoke stacks, horns, and other permanently attached equipment on locomotive 10. The rail structure 20 is composed of a series of removable rail sections or segments 22*a*–22*e* with a series of rail joints 24 therebetween. The rail sections 22*a*–22*e* are preferably made from steel I-beams attached along the top of locomotive 10. The rail joints 24 are offset to one side of roofjoints 16 between roof plates 14*a*–14*d* over the compartments of locomotive 10. The rail joints 24 allow a specific rail section to be released from the adjacent rails and/or removed so that an underlying roof plate can be opened to provide access to a compartment to be serviced.

Figure 4:
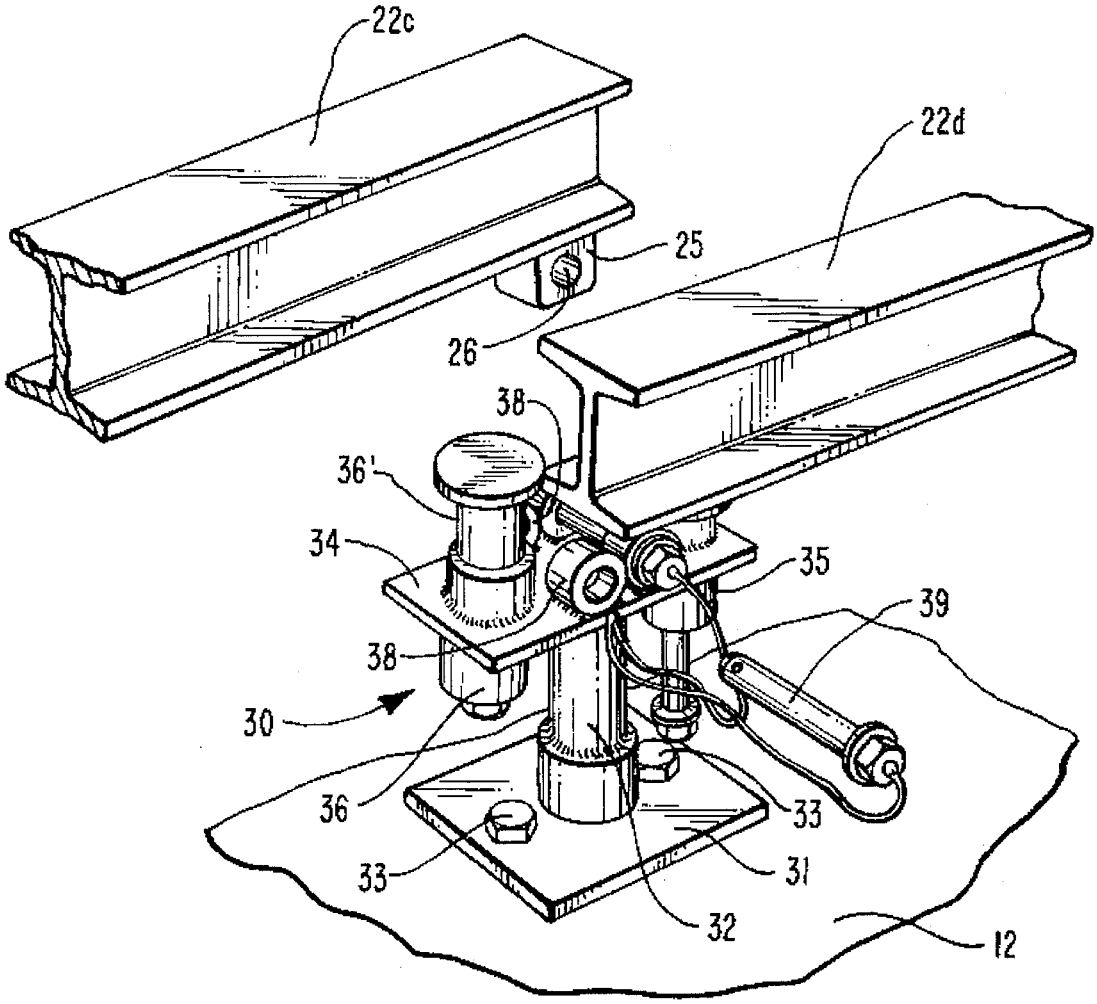
FIG. 4 is an enlarged perspective view of the segmented rail structure employed on the locomotive of FIG. 3 with one rail segment released.
Figure 5:
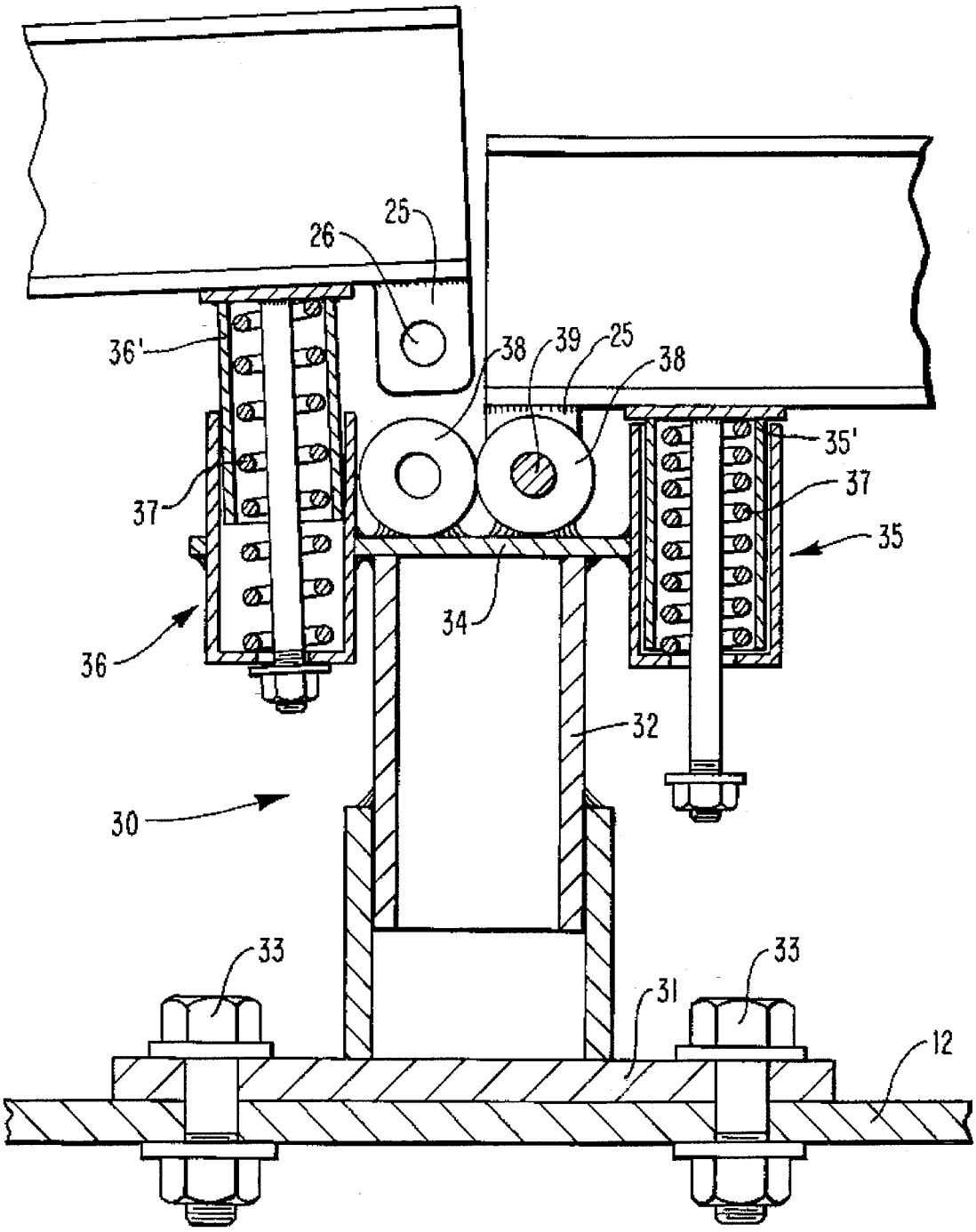
FIG. 5 is a side view of the segmented rail structure of FIG. 4 in partial cross section with one rail segment released.

The rail structure 20 is supported by a series of rail posts 30 located beneath rail joints 24, as illustrated in FIG. 3. An enlarged view of a rail post 30 with more detail of the surrounding structure is shown in FIGS. 4 and 5. The rail post 30 includes a base plate 31 that supports a cylindrical shaft 32 which is preferably made from an interconnected pipe structure that has been welded together so that shaft 32 is at the appropriate height. The base plate 31 of rail post 30 is preferably attached to roof 12 of locomotive 10 by a pair of bolts 33. A top plate 34 is attached to the top of shaft 32 and holds a pair of spring biased support members, including a forward support member 35 and a rearward support member 36. The support members 35 and 36 are permanently positioned on top plate 34 so as to be on either side of rail joint 24. The support members 35 and 36 are preferably formed from telescoping pipes 35' and 36' that are spring loaded so that the overlying rail sections compress the spring mechanism 37 in support members 35 and 36 when placed thereover. As shown in FIGS. 4 and 5, when rail section 22*c* is raised to permit a compartment in locomotive 10 to be accessed, the telescoping portion section 36' of support member 36 automatically rises up by action of spring mechanism 37 to block the open end of the remaining rail section 22*d*.

A rail extension 25 is formed at the ends of each rail section that overlay rail post 30, as illustrated in FIGS. 4 and 5. Rail extension 25 extends in a perpendicular direction to the length of the rail section and defines an aperture 26 therethrough. When a rail section is positioned over rail post 30, rail extension 25 fits down between a pair of post rings 38 attached to top plate 34 of rail post 30. The pair of post rings 38 are located below each rail section 22*c* and 22*d* on either side of rail joint 24 to provide a connection point for each rail section onto rail post 30.

The rail sections are secured to rail post 30 by a quick locking pin mechanism. A locking pin 39 is inserted through post rings 38 and aperture 26 of rail extension 25 in order to secure the rail section, as rail section 22*d* is shown secured in FIG. 4. This keeps the rail section in place until locking pin 39 is removed, thereby permitting the rail section to be released. Locking pin 39 is preferably a quick pin with a hairpin cotter.

Figure 6:
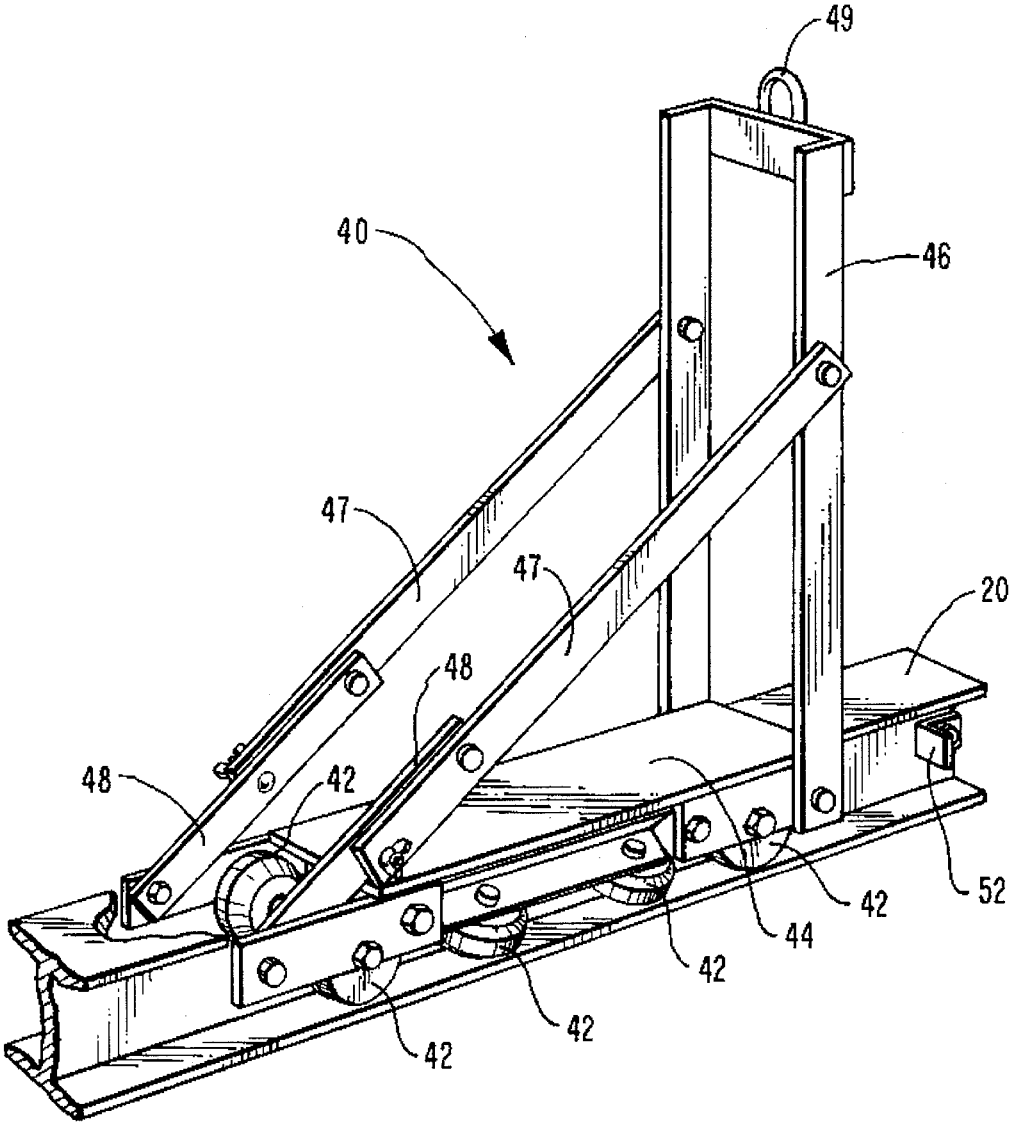
FIG. 6 is an enlarged perspective view of the moveable trolley engaged on segmented rail structure of FIG. 3 according to the present invention.
Figure 4:
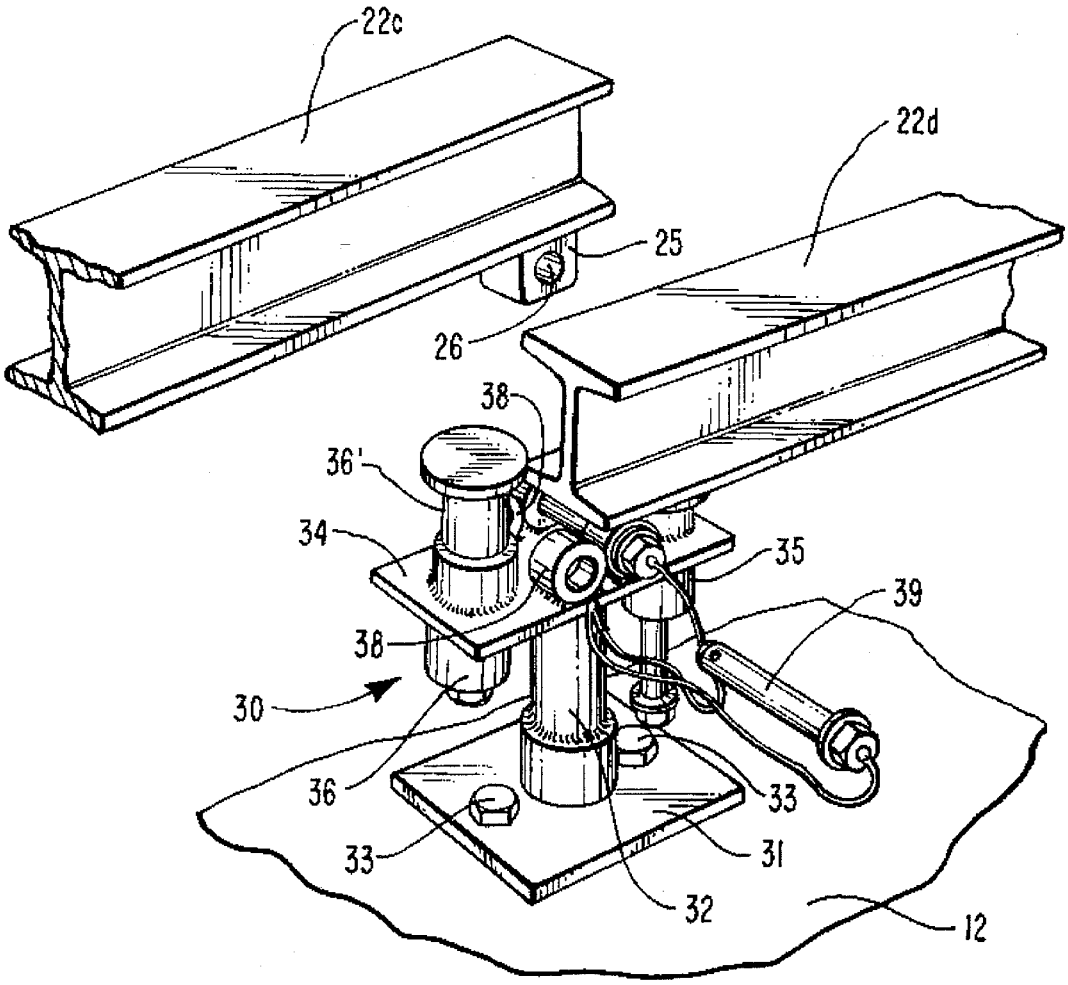

As shown in FIGS. 6 and 7, a movable trolley 40 having a plurality of wheels 42 engages rail structure 20 with trolley 40 moveable in either direction. The trolley 40 has a trolley frame 44 that sits above rail structure 20, and an extendable arm 46 attached to frame 44 that can be raised up or folded down parallel with rail structure 20 when not in use. The extendable arm 46 is supported in a raised position by a pair of longer struts 47 connected to a pair of shorter struts 48. The extendable arm 46, longer struts 47, shorter struts 48, and trolley frame 44 are interconnected together with appropriate fasteners to allow arm 46 to be raised up or folded down.

The extendable arm 46 includes a means for releasably anchoring a safety cord or lanyard to trolley 40. One presently preferred embodiment of this anchoring means comprises a loop 49 attached to the distal end of extendable arm 46 as shown in FIGS. 6 and 7. It will be appreciated that the anchoring means can be implemented using various other equivalent structures and be within the intended scope of the invention. For example, loop 49 can be formed of various shapes and sizes. When a maintenance person attaches a lanyard to loop 49 on extendable arm 46 of trolley 40, the person is safely tethered and prevented or restrained from falling while traversing the length of locomotive 10.

The materials used to make trolley 40 are preferably metals such as stainless steel. A particularly preferred material used to make the components of the trolley is A36 steel with a yield point of 36,000 psi. Grade 5 fasteners having an 85,000 psi proof load are also preferably used to connect the trolley components together.

As shown in FIG. 6, a stop member 52 is disposed at the ultimate end of rail structure 20 to prevent trolley 40 from coming off the end of rail structure 20. FIG. 7 illustrates that when a rail section is removed, moveable section 35' of support member 35 raises up to block wheels 42 of trolley 40 from going beyond support member 35', thereby keeping trolley 40 safely fixed on rail structure 20 even if a rail section is taken out. The support members also force maintenance personnel to reconnect the rail sections that have been removed. If this is not done, the rail structure is out of position. In addition, the support members load the rail sections to prevent rattling at the quick pin connection.

It is also possible to use more than one trolley at a time on rail structure 20 to allow more than one person to move about on roof 12 of locomotive 10. Preferably, a trolley is employed at each end of rail structure 20. In addition, trolley 40 can be locked in place when not in use. The trolley is preferably designed to safely restrain a horizontal load at the top of extendable arm 46 of a minimum of 300 pounds. The safety factor for the trolley engaged on the rail structure according to the present invention is preferably about 350 pounds at 4 feet free-fall.

The only equipment required for working on a locomotive with the safety system of the invention is a safety belt and lanyard. Preferably, a body-belt with a permanently attached retractable webbing lanyard and a quick lock hook at the end of the webbing lanyard is utilized.

The safety system of the present invention provides protection even before a mechanic climbs onto the roof of a locomotive. A lanyard can be snapped to an attachment ring on the end of the rail structure at one end of the locomotive, providing protection to a mechanic moving from the ladder at the end of the locomotive to the locomotive roof. Once on top of the locomotive, the mechanic will transfer the lanyard to the trolley, elevate the extendable arm of the trolley, and release the locks securing the trolley in place at the end of the rail structure. The mechanic then simply moves the trolley to the desired location and begins the work. The lanyard attached to the trolley will restrain the mechanic from falling off the edge of the locomotive under any circumstance, thus eliminating the potential for fatalities or serious injuries.

The rail structure with releasable and/or removable rail sections allows a mechanic to open a designated roof plates on the locomotive while still attached to the trolley. A rail section that has been removed to open a roof plate on the locomotive may be replaced back on the rail structure so that the trolley can be used while a mechanic is working in a locomotive compartment. In addition, more than one mechanic may be attached to one trolley if necessary. The trolley can also be locked in any desired place along the rail structure for stationary work when needed.

The safety system of the present invention can be originally built on a new locomotive or can be easily retrofitted to the roof of a conventional older locomotive already in operation. The present safety system provides full protection and restraint anywhere a person may be required to perform maintenance on top of a locomotive and is usable indoors or outside. The safety system employed on a locomotive can be used at any location, such as in shops, servicing areas, and on the main line in any weather during road trips. Furthermore, the safety system of the invention is compatible with all the different models of locomotives in operation. The present safety system has a minimum set up time and is easy to use, thereby ensuring usage of the system. In addition, the safety system provides protection by restraining a person from falling in all types of work on top of a locomotive.

The present invention is described in connection with an embodiment in which the rails are above the compartments to be accessed. The same structure of the present invention is equally applicable for applications in which the safety rail is below the compartments to be accessed. Similarly, the rails may be arranged vertically employing the present invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A safety system for restraining and preventing a person from falling off an elevated structure, comprising:

(a) a rail structure comprising a plurality of adjacent, releasable rail sections, and a series of rail posts to support adjacent rail sections, the rail posts comprising a pair of extendable support members attached to each of the rail posts, wherein the support members automatically extend when a rail section is released; and (b) a moveable trolley apparatus comprising a plurality of wheels engageable with the rail sections, and an extendable arm having means for releasibly anchoring a safety lanyard to the trolley apparatus; wherein the trolley apparatus is prevented from coming off of the rail structure when the support members are extended.

2. The safety system of claim 1, wherein each rail further comprises a rail extension attached at each end of the rail sections, each rail extension defining an aperture therethrough.

3. The safety system of claim 2, further comprising at least one post ring, the post ring defining an aperture therethrough, the post ring affixed to the rail posts such that the aperture of the post ring is aligned with the aperature of the rail extension when the rail is in place.

4. The safety system of claim 3, wherein the rail sections are secured to the rail posts by a locking pin mechanism.

5. The safety system of claim 4, wherein the locking pin mechanism comprises a quick pin with a hairpin cotter that can be inserted through the apertures of the post rings and of the rail extension.

6. The safety system of claim 1, wherein the rail sections have a series of rail joints therebetween.

7. The safety system of claim 6, wherein the rail posts are positioned below the rail joints.

8. The safety system of claim 6, wherein the support members are attached to the rail posts on either side of the rail joints.

9. The safety system of claim 1, wherein the rail sections are formed from steel I-beams.

10. The safety system of claim 1, wherein the support members are telescoping pipes that are spring-loaded to extend the support member when a rail is released.

11. The safety system of claim 1, wherein the trolley apparatus is made of stainless steel.

12. The safety system of claim 1, wherein the trolley apparatus further comprises a trolley frame that sits above the rail structure.

13. The safety system of claim 1, wherein the extendable arm on the trolley apparatus can be raised up or folded down parallel with the rail structure when not in use.

14. The safety system of claim 1, wherein the trolley apparatus can be locked in place on the rail structure when not in use.

15. The safety system of claim 1, wherein the means for releasibly anchoring a lanyard comprises a loop attached to a distal end of the extendable arm.

16. A safety system for restraining and preventing a person from falling off a locomotive, comprising:

(a) a rail structure attached to a roof of the locomotive, the rail structure comprising a plurality of adjacent, releasable rail sections, and a series of rail posts to support the rail sections, the rail posts comprising a pair of extendable support members attached to each of the rail posts, wherein the support members automatically extend when a rail section is removed; and (c) a moveable trolley apparatus comprising a trolley frame that sits above the rail structure, a plurality of wheels attached to the trolley frame and engageable with the rail sections, and an extendable arm attached to the trolley frame and having means for releasibly anchoring a lanyard to the trolley apparatus; wherein the trolley apparatus is prevented from coming off of the rail structure when the support members are extended.

17. The safety system of claim 16, further comprising a rail extension attached at each end of the rail sections, each rail extension defining an aperture therethrough.

18. The safety system of claim 17, further comprising at least one post ring, the post ring defining an aperture therethrough, the post ring affixed to the rail parts such that the aperture of the part ring is aligned with the aperture of the rail extension when the rail is in place.

19. The safety system of claim 18, wherein the rail sections are secured to the rail posts by a locking pin mechanism.

20. The safety system of claim 19, wherein the locking pin mechanism comprises a quick pin with a hairpin cotter that can be inserted through the apertures of the post rings and of the rail extension.

21. The safety system of claim 16, wherein the rail sections are formed from steel I-beams.

22. The safety system of claim 16, wherein the rail sections have a series of rail joints therebetween.

23. The safety system of claim 16, wherein the rail posts are positioned below the rail joints.

24. The safety system of claim 16, wherein the support members are attached to the rail posts on either side of the rail joints.

25. The safety system of claim 16, wherein the support members are telescoping pipes that are spring-loaded to extend the support members when a rail is released.

26. The safety system of claim 16, wherein the trolley apparatus is made of stainless steel.

27. The safety system of claim 16, wherein the extendable ann on the trolley apparatus can be raised up or folded down parallel with the rail structure when not in use.

28. The safety system of claim 16, wherein the trolley apparatus can be locked in place on the rail structure when not in use.

29. The safety system of claim 16, wherein the means for releasibly anchoring a lanyard comprises a loop attached to a distal end of the extendable arm.

30. The safety system of claim 16, wherein the rail structure runs the entire length of the locomotive.

31. The safety system of claim 16, wherein the rail structure is mounted about 12 inches above the roof of the locomotive.

32. A moveable trolley system comprising a rail structure including a plurality of removable rail sections supported by a series of rail posts with a pair of extendable support members attached to each of the rail posts, and a moveable trolley apparatus the moveable trolley apparatus comprising:

(a) a trolley frame that is supported by the rail structure;

(b) a plurality of wheels attached to the trolley frame and engageable with the rail sections; and (c) an extendable arm attached to the trolley frame and having a loop attached to a distal end thereof for releasably anchoring a lanyard to the trolley apparatus;

wherein the wheels of the trolley are retained in an engaged condition to at least one rail when the support members are extended, thereby preventing the trolley apparatus from coming off the rail structure.

33. The trolley system of claim 32, wherein the support members are telescoping pipes that are spring-loaded to extend the support member when the corresponding rail is released.

34. The trolley system of claim 32, wherein the trolley apparatus is made of stainless steel.

35. The trolley system of claim 32, wherein the extendable arm can be raised up or folded down parallel with the rail structure when not in use.

36. The trolley system of claim 32, wherein the trolley apparatus can be locked in place on the rail structure when not in use.

* * * * *